US011624518B2

(12) United States Patent
Locke et al.

(10) Patent No.: US 11,624,518 B2
(45) **Date of Patent: *Apr. 11, 2023**

(54) WATER SOURCE HEAT PUMP HEAD PRESSURE CONTROL FOR HOT GAS REHEAT

(71) Applicant: Daikin Applied Americas Inc., Minneapolis, MN (US)

(72) Inventors: Marcos Locke, Baldwinsville, NY (US); Benny DiMarco, Clay, NY (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 108 days.

This patent is subject to a terminal disclaimer.

(21) Appl. No.: 17/234,053

(22) Filed: Apr. 19, 2021

(65) Prior Publication Data

US 2021/0239334 A1 Aug. 5, 2021

Related U.S. Application Data

(63) Continuation of application No. 16/145,905, filed on Sep. 28, 2018, now Pat. No. 11,002,452.

(60) Provisional application No. 62/568,963, filed on Oct. 6, 2017.

(51) Int. Cl.

| | |
|---|---|
| ***F25B 13/00*** | (2006.01) |
| ***F24F 3/153*** | (2006.01) |
| ***F25B 30/02*** | (2006.01) |
| ***F25B 49/02*** | (2006.01) |

(52) U.S. Cl.

CPC ..... *F24F 3/153* (2013.01); *F25B 13/00* (2013.01); *F25B 30/02* (2013.01); *F25B 49/02* (2013.01); *F25B 2313/004* (2013.01); *F25B 2313/009* (2013.01); *F25B 2313/02731* (2013.01); *F25B 2313/02741* (2013.01); *F25B 2600/2517* (2013.01)

(58) Field of Classification Search

CPC ..... F24F 3/153; F25B 30/02; F25B 13/00; F25B 49/02

See application file for complete search history.

(56) References Cited

U.S. PATENT DOCUMENTS 4,102,389 A * 7/1978 Wills ..... F25B 47/022 62/158
5,076,780 A 12/1991 Erdman
7,275,384 B2 10/2007 Taras et al.

(Continued)

*Primary Examiner* — Nael N Babaa

(74) *Attorney, Agent, or Firm* — Global IP Counselors, LLP

(57) ABSTRACT

A method of conditioning air includes controlling a secondary refrigerant flow control valve to select between a first mode in which refrigerant flows from a discharge line to a main refrigerant flow control valve, and a second mode in which refrigerant flows from the discharge line to a gas reheat heat exchanger and then flows to the main refrigerant flow control valve. A heat transfer medium flow control valve is controlled to adjust the flow of the heat transfer medium into a heat source side heat exchanger. The heat transfer medium flow control valve allows the heat transfer medium to flow to the heat source side heat exchanger when the secondary refrigerant flow control valve is in the first mode, and adjusts the flow of the heat transfer medium to the heat source side heat exchanger when the secondary refrigerant flow control valve is in the second mode.

20 Claims, 11 Drawing Sheets

(56) References Cited

U.S. PATENT DOCUMENTS

| | | | |
|---|---|---|---|
| 7,287,394 | B2 | 10/2007 | Taras et al. |
| 2006/0053821 | A1 | 3/2006 | Taras et al. |
| 2011/0079032 | A1 | 4/2011 | Taras et al. |
| 2012/0222845 | A1 | 9/2012 | Kinder et al. |
| 2015/0338133 | A1 | 11/2015 | Havard, Jr. et al. |
| 2017/0044744 | A1 | 2/2017 | Everhart |

* cited by examiner

Hot Gas Reheat
COOLING Mode

Air Flow
LPRF
Relay OPEN
Thermostat send signal to relay (0-volts) keeping relay in Normally open position
In cooling mode switch is not employed
C
Switch OPEN
24 Volts
NF
Air Flow
HPRF
Water Out
Water Valve (NO) Open Allowing Water Flow 0-volts
Water In

WATER SOURCE HEAT PUMP HEAD PRESSURE CONTROL FOR HOT GAS REHEAT

CROSS-REFERENCE TO RELATED APPLICATIONS

This application is a continuation of U.S. patent application Ser. No. 16/145,905, filed Sep. 28, 2018, which claims the benefit of U.S. Provisional Application No. 62/568,963, filed Oct. 6, 2017. The entire disclosures of U.S. patent application Ser. No. 16/145,905 and U.S. Provisional Application No. 62/568,963 are hereby incorporated herein by reference.

BACKGROUND

Field of the Invention

The present invention generally relates to a refrigerant system. More specifically, the present invention relates to a heat pump with head pressure control for hot gas reheat.

Background Information

Refrigerant systems are utilized to control the temperature and humidity of air in various indoor environments to be conditioned.

A heat pump is a refrigerant system that is typically operable in both cooling and heating modes. While air conditioners are familiar examples of heat pumps, the term "heat pump" is more general and applies to many HVAC (heating, ventilating, and air conditioning) devices used for space heating or space cooling. When a heat pump is used for heating, it employs the same basic refrigeration-type cycle used by an air conditioner or a refrigerator, but in the opposite direction, releasing heat into the conditioned space rather than the surrounding environment. In this use, heat pumps generally draw heat from cooler external air, water or from the ground.

In a cooling mode, a heat pump operates like a typical air conditioner, i.e., a refrigerant is compressed in a compressor and delivered to a condenser (or an outdoor heat exchanger). In the condenser, heat is exchanged between a medium such as outside air, water or the like and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

Reversible heat pumps work in either direction to provide heating or cooling to the internal space as mentioned above. Reversible heat pumps employ a reversing valve to reverse the flow of refrigerant from the compressor through the condenser and evaporation coils. In heating mode, the outdoor coil is an evaporator, while the indoor coil is a condenser. The refrigerant flowing from the evaporator (outdoor coil) carries the thermal energy from outside air (or soil) indoors. Vapor temperature is augmented within the pump by compressing it. The indoor coil then transfers thermal energy (including energy from the compression) to the indoor air, which is then moved around the inside of the building by an air handler.

Alternatively, thermal energy can be transferred to water, which is then used to heat the building via radiators or underfloor heating. The heated water may also be used for domestic hot water consumption. The refrigerant is then allowed to expand, cool, and absorb heat from the outdoor temperature in the outside evaporator, and the cycle repeats. This is a standard refrigeration cycle, save that the "cold" side of the refrigerator (the evaporator coil) is positioned so it is outdoors where the environment is colder.

In addition, instead of an air source heat pump, water source heat pumps can also be provided in which the outdoor unit exchanges heat with a water source, and the indoor unit exchanges heat with air. In cooling mode the cycle is similar, but the outdoor coil is now the condenser and the indoor coil (which reaches a lower temperature) is the evaporator. This is the familiar mode in which air conditioners operate. If a water coil is used for the so-called outdoor heat exchanger, it is not necessary for the water coil to be outside.

U.S. Pat. Nos. 7,275,384 and 7,287,394 disclose prior art heat pumps with reheat circuits.

SUMMARY

This invention relates to a heat pump system that is operable in both cooling and heating modes, and which utilizes a hot gas reheat coil operable in a hot gas reheat mode.

While reheat coils have been incorporated into the air source air conditioning systems operating in the cooling mode, they have not been utilized in water source heat pump systems as disclosed herein.

One illustrative embodiment utilizes a pressure switch located on compressor discharge line, a two way water valve located at the inlet of the coax coil and a relay to control the afore mentioned water valve. The purpose of this switch is to control the operation of a water valve either allowing water flow or stopping water flow to the coax coil depending on the compressor discharge pressure switch settings. The pressure switch is allowed to energize or deenergize the two way valve maintaining the discharge pressure (saturated discharge temperature) over an operating window. Maintaining an adequate discharge pressure allows proper operation of the TEV and proper flow of refrigerant to the evaporator preventing the evaporator coil from dropping below the freezing point of water at the surface of the coil. Without the arrangement inherent safeties in the control system of the water source heat pump could shut the unit down. The switch also ensures that discharge pressure does not elevate above the maximum operating pressure allowed. The configuration is set up to not be employed when the unit is in straight cooling mode or in heating mode. Allowing operation during either of these modes would inhibit the operating efficiency of the water source heat pump.

The system can be configured to utilize a normally open or normally closed two way valve depending on the customer's needs.

This invention can improve the overall operating window of hot gas reheat operation improving compressor reliability by reducing compressor cycling and avoiding nuisance trips as a result of coil freeze ups thereby reducing overall warranty claims. This system would also be a suitable response to units which offer hybrid systems to address similar applications.

One or more of the foregoing objects can basically be attained by providing an air conditioning system and/or method in accordance with any one or more of the aspects below, and/or any of the features discussed below and/or illustrated in the attached drawings.

A method of conditioning air in accordance with a first aspect includes operating a heat pump including a compressor, a usage side heat exchanger, a heat source side heat exchanger, an expansion valve, a main refrigerant flow control valve, a gas reheat heat exchanger, a fan, a secondary refrigerant flow control valve, and a heat transfer medium flow control valve. The compressor is configured to deliver compressed refrigerant to a discharge line connected to a refrigerant circuit and receive a refrigerant from a suction line. The heat source side heat exchanger is arranged to exchange heat between a heat transfer medium and the refrigerant flowing therethrough. A gas reheat heat exchanger is connected in the refrigerant circuit. A fan is disposed to direct an airflow across the usage side heat exchanger and the gas reheat heat exchanger into a target space. The secondary refrigerant flow control valve is controlled to select between a first mode in which refrigerant flows from the discharge line to the main refrigerant flow control valve, and a second mode in which refrigerant flows from the discharge line to the gas reheat heat exchanger and then flows to the main refrigerant flow control valve. The heat transfer medium flow control valve is controlled to adjust the flow of the heat transfer medium into the heat source side heat exchanger. The heat transfer medium flow control valve allows the heat transfer medium to flow to the heat source side heat exchanger when the secondary refrigerant flow control valve is in the first mode, and the heat transfer medium flow control valve is configured to adjust the flow of the heat transfer medium to the heat source side heat exchanger when the secondary refrigerant flow control valve is in the second mode.

A method of conditioning air in accordance with a second aspect is the method of conditioning air of the first aspect, in which the main refrigerant control valve is switchable between a cooling mode in which refrigerant flows from the discharge line through a refrigerant circuit, to the heat source side heat exchanger, to the expansion valve and then to the usage side heat exchanger, and a heating mode in which refrigerant flows from the discharge line through the refrigerant circuit to the usage side heat exchanger, to the expansion valve and then to the heat source side heat exchanger.

A method of conditioning air in accordance with a third aspect is the method of conditioning air of the first or second aspect, in which the heat transfer medium flow control valve is disposed on an inlet side of the heat source side heat exchanger.

A method of conditioning air in accordance with a fourth aspect is the method of conditioning air of any of the first to third aspects, in which the heat transfer medium of the heat source side heat exchanger is water.

A method of conditioning air in accordance with a fifth aspect is the method of conditioning air of any of the first to fourth aspects, in which the source side heat exchanger is a coaxial heat exchanger.

A method of conditioning air in accordance with a sixth aspect is the method of conditioning air of any of the first to fifth aspects, in which the step of controlling heat transfer medium flow control valve is performed using a control switch and wherein the heat transfer medium flow control valve is disposed between a discharge port of the compressor and an inlet of the gas reheat heat exchanger.

A method of conditioning air in accordance with a seventh aspect is the method of conditioning air of the sixth aspect, in which the control switch is connected in a control circuit to the heat transfer medium flow control valve.

A method of conditioning air in accordance with an eighth aspect is the method of conditioning air of any the first to seventh aspects, in which the control circuit includes a relay that receives a wired or wireless signal from a thermostat to open or close the relay.

A method of conditioning air in accordance with a ninth aspect is the method of conditioning air of the seventh of eighth aspect, in which the control switch includes a pressure control switch that is normally open unless a pressure of refrigerant at the control switch falls below an actuation pressure.

A method of conditioning air in accordance with a tenth aspect is the method of conditioning air of the ninth aspect, in which closing the control switch once the pressure at the control switch has fallen below the actuation pressure, and opening the control switch when the pressure at the control switch rises above a release pressure that is higher than the actuation pressure.

A method of conditioning air in accordance with an eleventh aspect is the method of conditioning air of the tenth aspect, in which when the pressure control switch is in a normally open position, the pressure control switch remains in the open position even when the pressure at the control switch falls below the release pressure.

A method of conditioning air in accordance with a twelfth aspect is the method of conditioning air of any one of the first to eleventh aspects, in which the secondary refrigerant flow control valve is a three-way valve that selectively communicates refrigerant from the refrigerant circuit to the gas reheat heat exchanger.

A method of conditioning air in accordance with a thirteenth aspect is the method of conditioning air of any of the first to twelfth aspects, in which the main refrigerant flow control valve is a four-way valve.

A method of conditioning air in accordance with a fourteenth aspect is the method of conditioning air of any of the first to thirteenth aspects, in which the gas reheat heat exchanger is positioned upstream of the usage side heat exchanger in the gas reheat mode along the refrigerant circuit.

A method of conditioning air in accordance with a fifteenth aspect is the method of conditioning air of any of the first to fourteenth aspects, in which the gas reheat heat exchanger is positioned upstream of the main refrigerant flow control valve in the gas reheat mode along the refrigerant circuit.

A method of controlling the temperature and humidity of air using a heat pump in accordance with a sixteenth aspect includes compressing a refrigerant using a compressor. The compressor is configured to direct the compressed refrigerant to a discharge line connected to a refrigeration circuit. A first mode or a second mode is selected. In the first mode, refrigerant flows from the discharge line to a main refrigerant flow control valve. In the second mode, refrigerant flows from the discharge line to a gas reheat heat exchanger and then flows to the main refrigerant flow control valve. The flow of a heat transfer medium is adjusted to a heat source side heat exchanger when the second mode is selected.

A method of controlling the temperature and humidity of air using a heat pump in accordance with a seventeenth aspect is the method of controlling the temperature and humidity of air using a heat pump of the sixteenth aspect, in which the step of selecting between a first mode and a second mode is performed using a secondary refrigerant flow control valve that is in communication, directly or indirectly, with a thermostat.

A method of controlling the temperature and humidity of air using a heat pump in accordance with an eighteenth aspect is the method of controlling the temperature and humidity of air using a heat pump of the sixteenth or seventeenth aspect, in which the step of adjusting the flow of the heat transfer medium is performed using a heat transfer medium flow control valve that is in communication, directly or indirectly, with a thermostat.

A method of controlling the temperature and humidity of air using a heat pump in accordance with a nineteenth aspect is the method of controlling the temperature and humidity of air using a heat pump of the seventeenth or eighteenth aspect, further including selecting between a cooling mode in which refrigerant flows from the discharge line through the refrigeration circuit, to the heat source side heat exchanger, to an expansion valve and then to a usage side heat exchanger, and a heating mode in which refrigerant flows from the discharge line through the refrigeration circuit to the usage side heat exchanger, to the expansion valve and then to the heat source side heat exchanger.

A method of controlling the temperature and humidity of air using a heat pump in accordance with a twentieth aspect is the method of controlling the temperature and humidity of air using a heat pump of the nineteenth aspect, in which the step of selecting between a cooling mode and a heating mode is performed using a main refrigerant control valve that is in communication, directly or indirectly, with a thermostat.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENT(S)

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
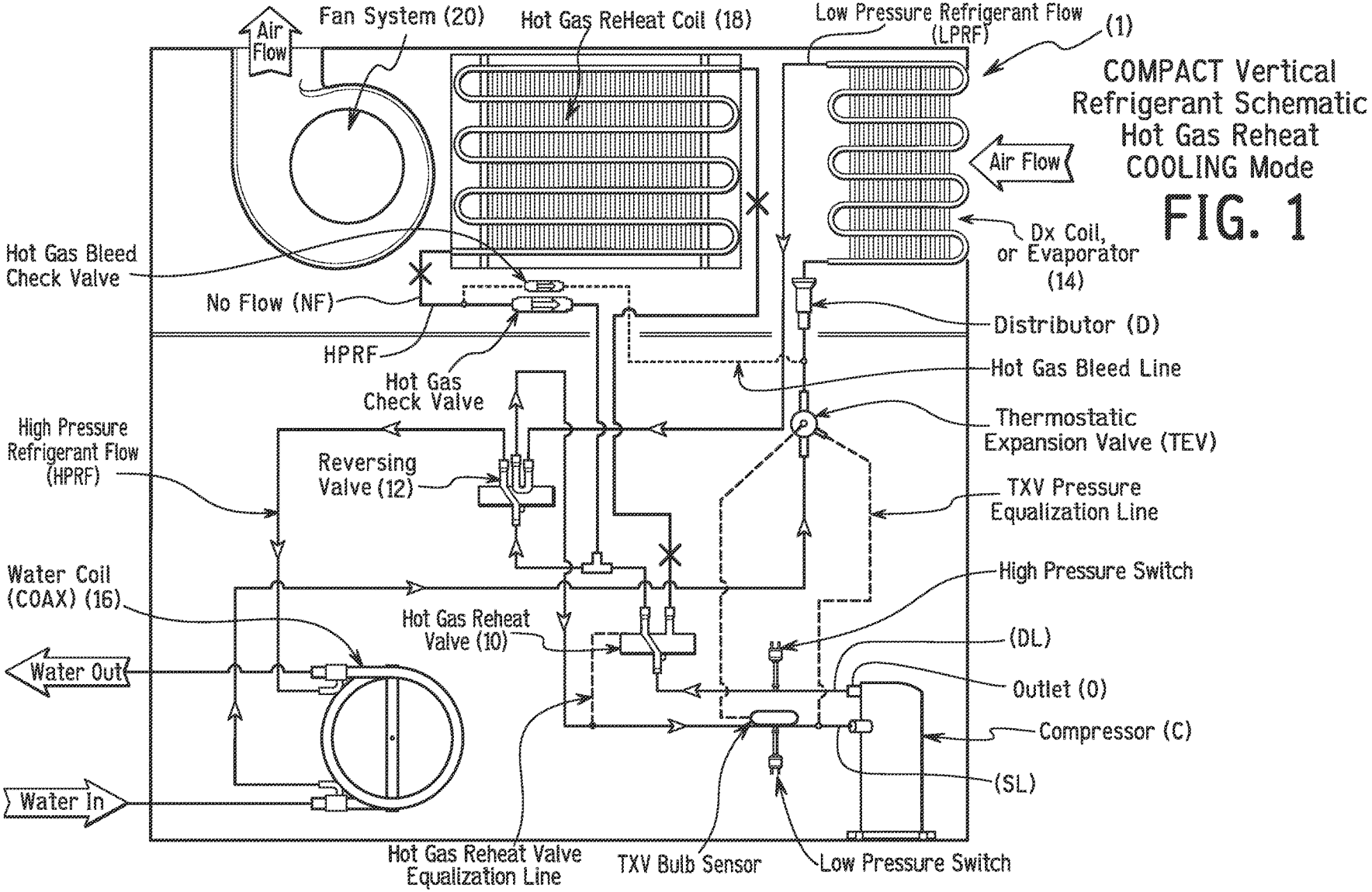
FIG. 1 illustrates a conventional water source refrigerant heat pump schematic, in a cooling mode.
Figure 2:
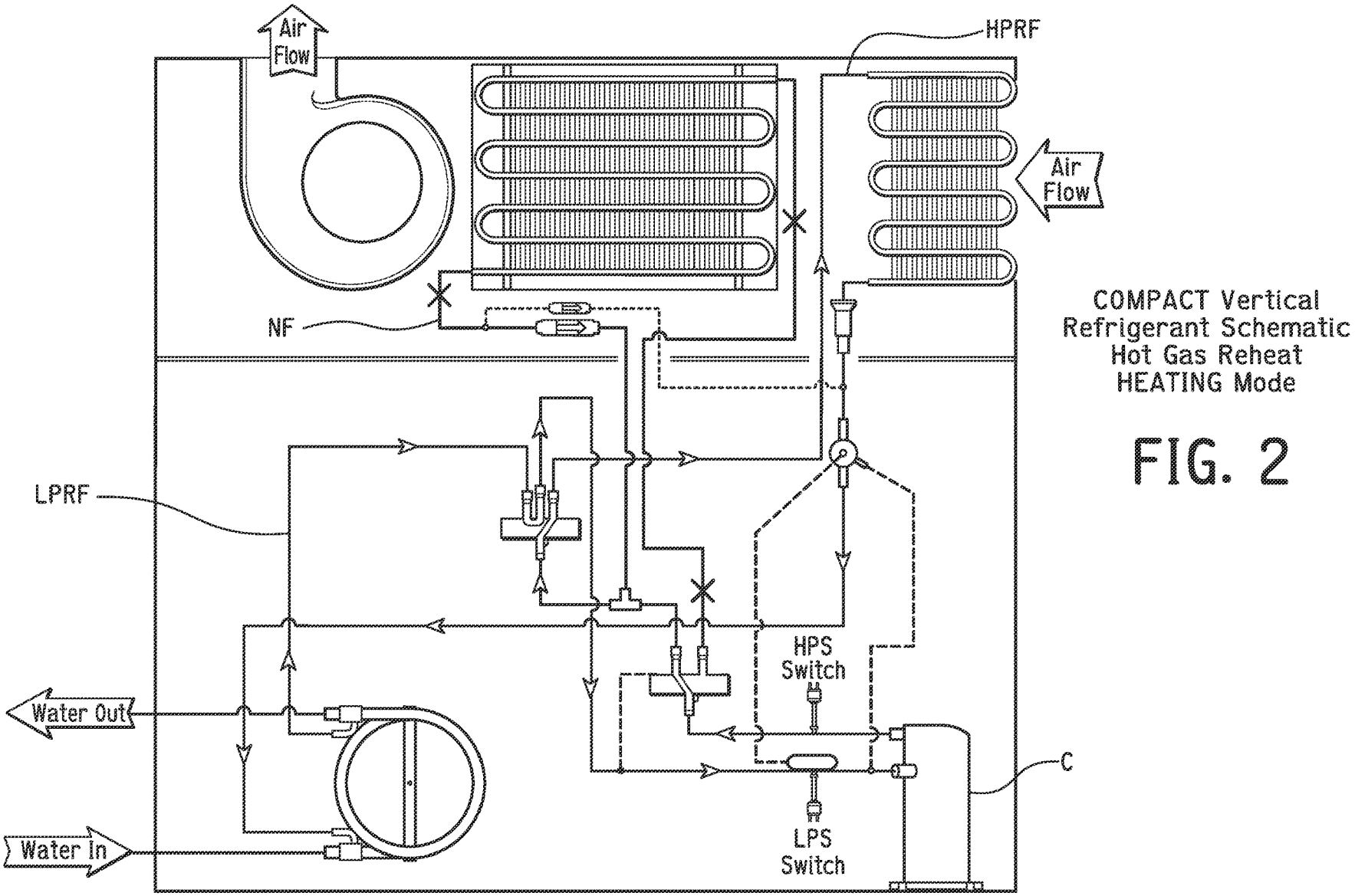
FIG. 2 illustrates the heat pump schematic of FIG. 1, in a heating mode.
Figure 3:
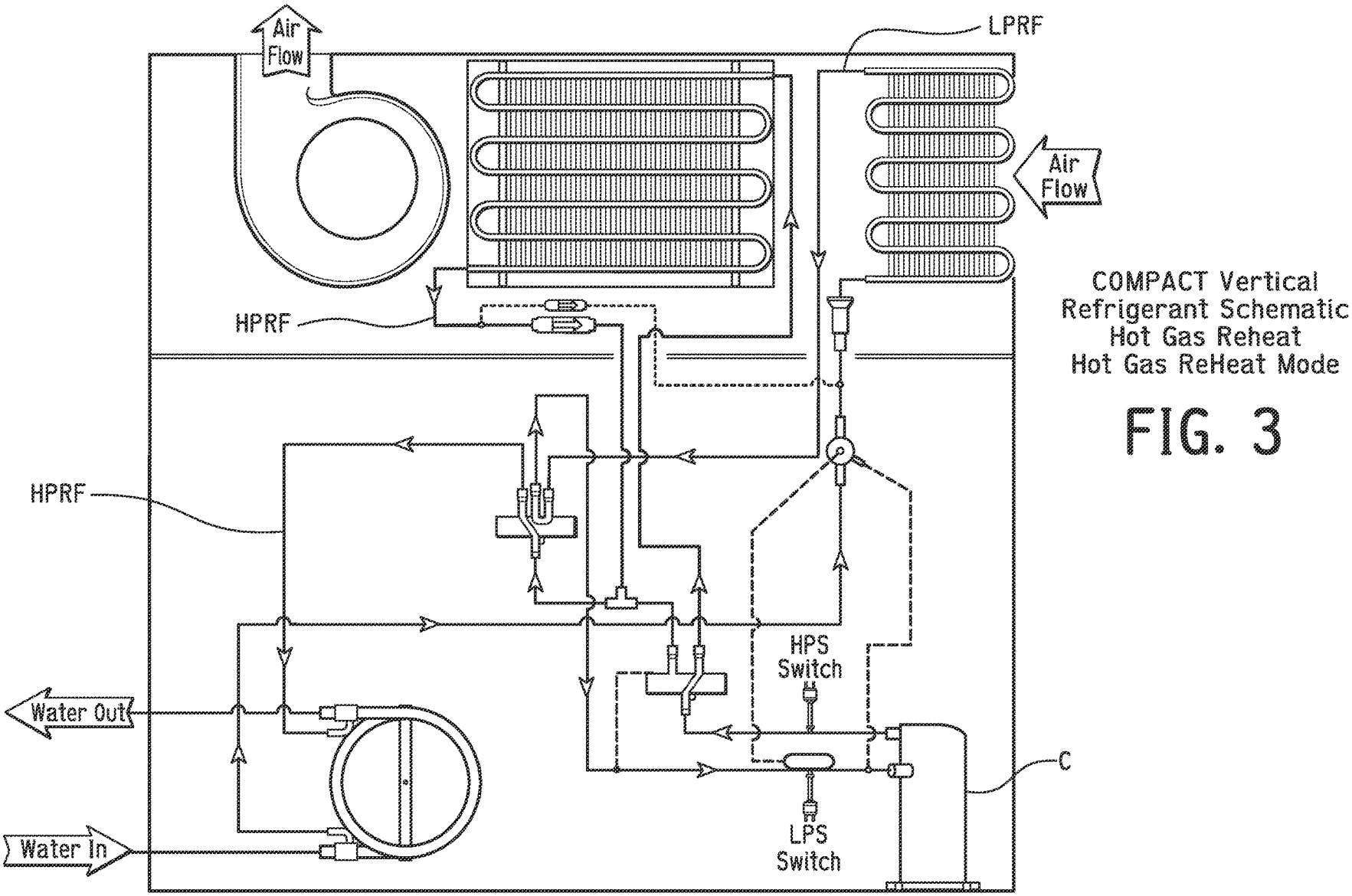
FIG. 3 illustrates the heat pump schematic of FIGS. 1-2, but in a hot gas reheat mode.
Figure 4:
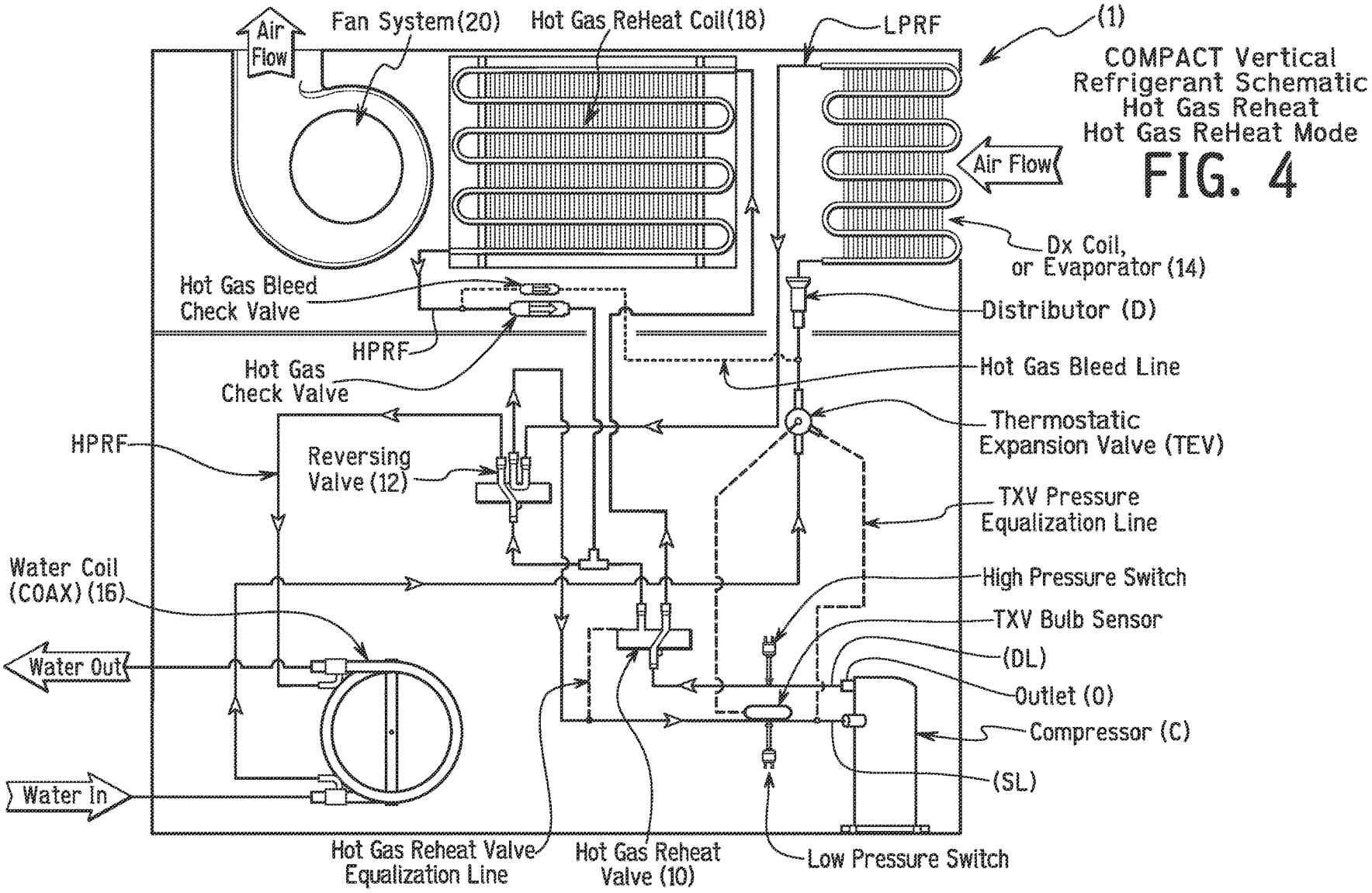
FIG. 4 illustrates the heat pump schematic of FIG. 3, in a hot gas reheat mode and with system parts identified for convenience.

Referring initially to FIGS. 1-4, a conventional water source heat pump (1) is illustrated. FIG. 1 shows the cooling mode, FIG. 2 shows the heating mode and FIG. 3 shows the hot gas reheat mode. FIG. 4 also shows the hot gas reheat mode just like FIG. 3 but further includes labels for the parts of system. These parts are the same in FIGS. 1-8, and thus, may not be included in all the Figures for the sake of convenience.

In the cooling mode of FIG. 1, compressed high pressure refrigerant flow (HPRF) exits the compressor (C) and flows through the hot gas reheat valve (10) to the reversing valve (12), through the water coil (16) to the thermostatic expansion valve (TEV). The TEV then reduces the pressure of the refrigerant. The resulting low pressure refrigerant flow (LPRF) then flows through a distributor (D) and then through the DX coil or the Evaporator (14), back through the reversing valve (12) and back to the suction side of the compressor (C). Note the refrigerant does not flow through the hot gas reheat coil (18) (note the "x" on the flow path at several locations).

In the heating mode of FIG. 2, compressed high pressure refrigerant flow (HPRF) exits the compressor (C) and flows through the hot gas reheat valve (10) to the reversing valve (12), through the DX coil or the Evaporator (14), and through the distributor (D) to the thermostatic expansion valve (TEV). The TEV then reduces the pressure of the refrigerant. The resulting low pressure refrigerant flow (LPRF) then flows through the water coil (16), back through the reversing valve (12) and back to the suction side of the compressor (C). Note the refrigerant does not flow through the hot gas reheat coil (18) (note the "x" on the flow path at several locations).

In the hot gas reheat mode shown in FIGS. 3-4, compressed high pressure refrigerant flow (HPRF) exits the compressor (C) and flows through the hot gas reheat valve (10) (the flow at the hot gas reheat valve (10) is switched as compared to the cooling and heating modes) to the hot gas reheat coil (18), through the hot gas reheat coil (18), through the hot gas check valve, through the reversing valve (12), and through the water coil (16) to the TEV. The TEV then reduces the pressure of the refrigerant. The resulting low pressure refrigerant flow (LPRF) then flows through the distributor (D), the DX coil or Evaporator (14), back through the reversing valve (12) and back to the suction side of the compressor (C).

In FIGS. 1-4, the hot gas reheat valve (10) is a conventional three-way valve that sends refrigerant out of only one of the outlets as shown in the Figures.

Figure 5:
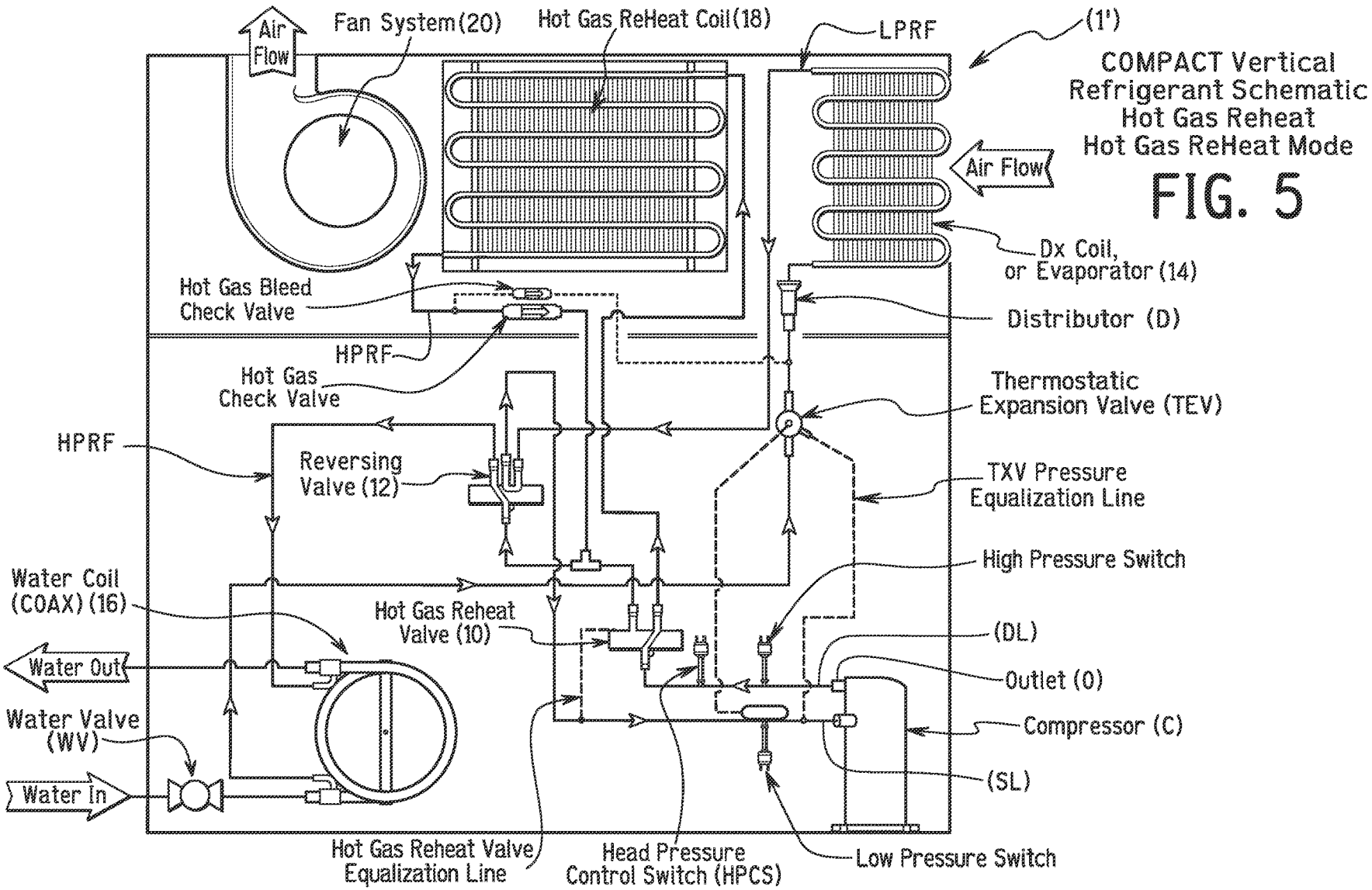
FIG. 5 illustrates an embodiment of a water source refrigerant heat pump schematic, which is a modification of the schematic of FIGS. 1-4, in a hot gas reheat mode and with system parts identified for convenience like FIG. 4, but also illustrating the head pressure control switch (HPCS) and water valve (WV) in accordance with the embodiment.

Referring now to FIGS. 5-14, an example of a heat pump (1') in accordance with the present invention will not be explained. Referring initially to FIGS. 5-8, a heat pump (1') is illustrated that is a modified version of the heat pump (1) illustrated in FIGS. 1-4. Specifically, the heat pump (1') illustrated in FIGS. 5-8 includes one example of a structure that allows adjustment of the water flow to the water coil (16) during the hot gas reheat mode. Specifically, the heat pump (1') of FIGS. 5-8 includes a water valve (WV) disposed at an inlet of the water coil (16) and a head pressure control switch (HPCS) disposed between the outlet (0) of the compressor (C) and the hot gas reheat valve, as best shown in FIG. 5.

Figure 6:
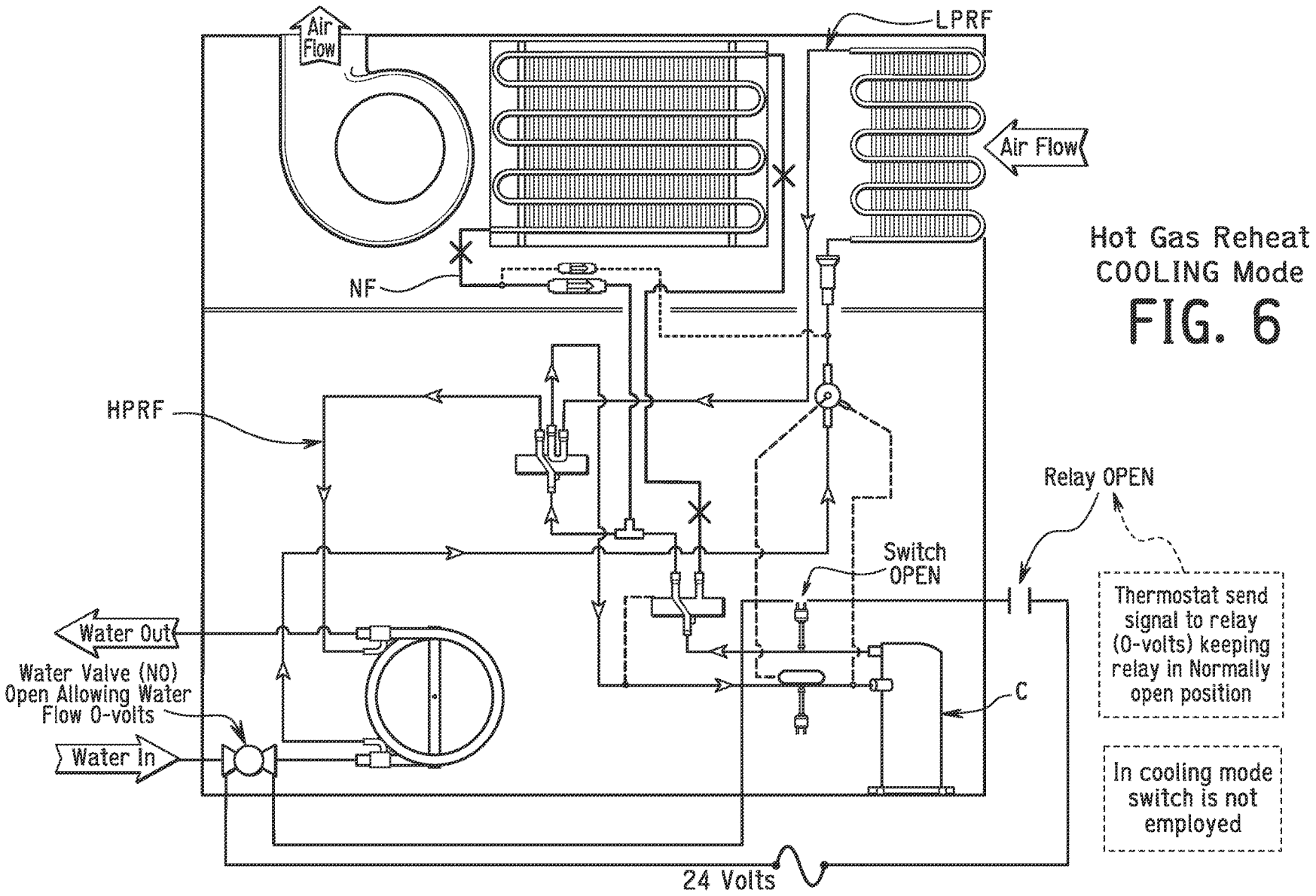
FIG. 6 is a schematic view of the heat pump illustrated in FIG. 5, in the cooling mode with the switch open and the relay open.
Figure 7:
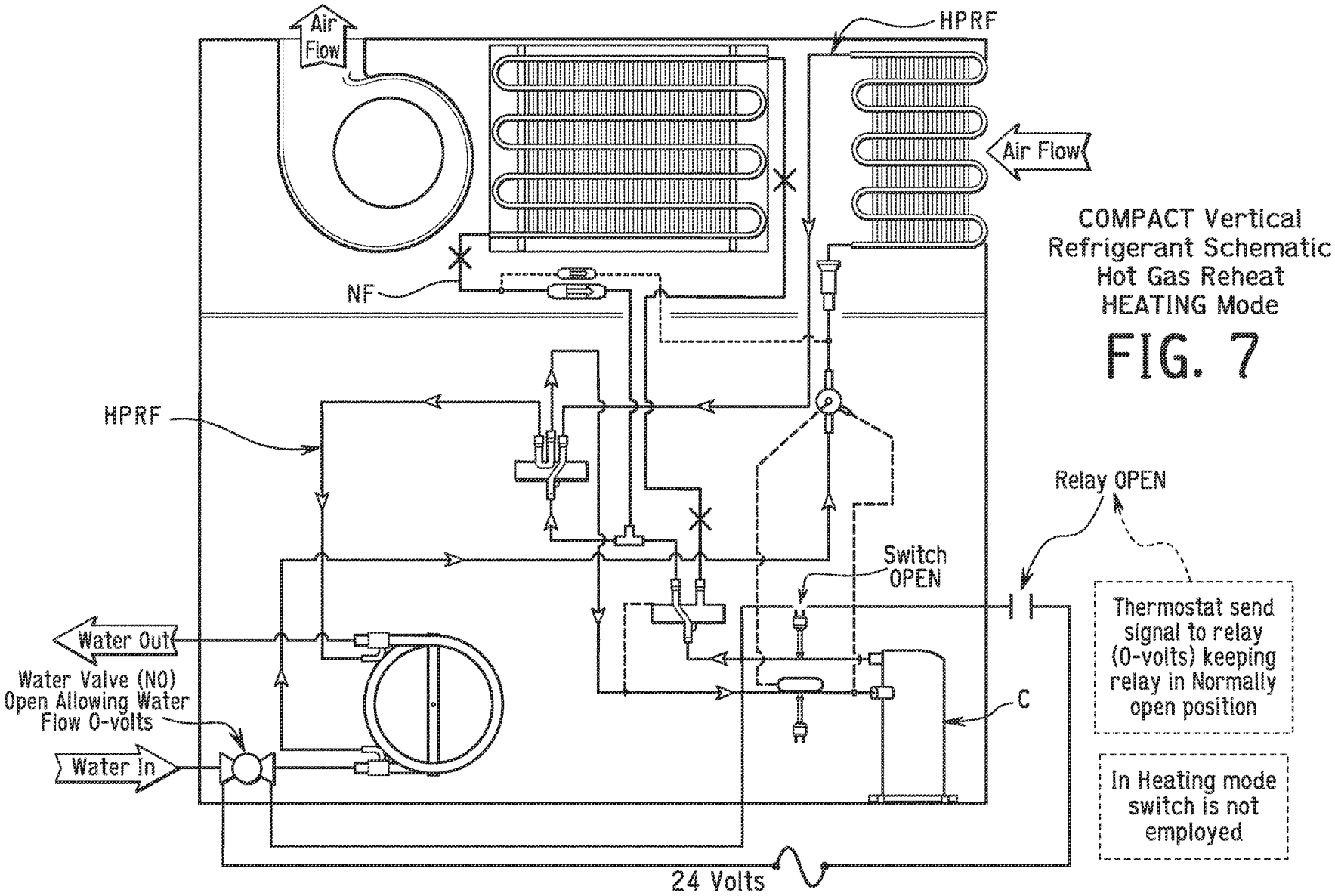
FIG. 7 is a schematic view of the heat pump illustrated in FIGS. 5-6, in the heating mode with the switch open and the relay open.
Figure 8:
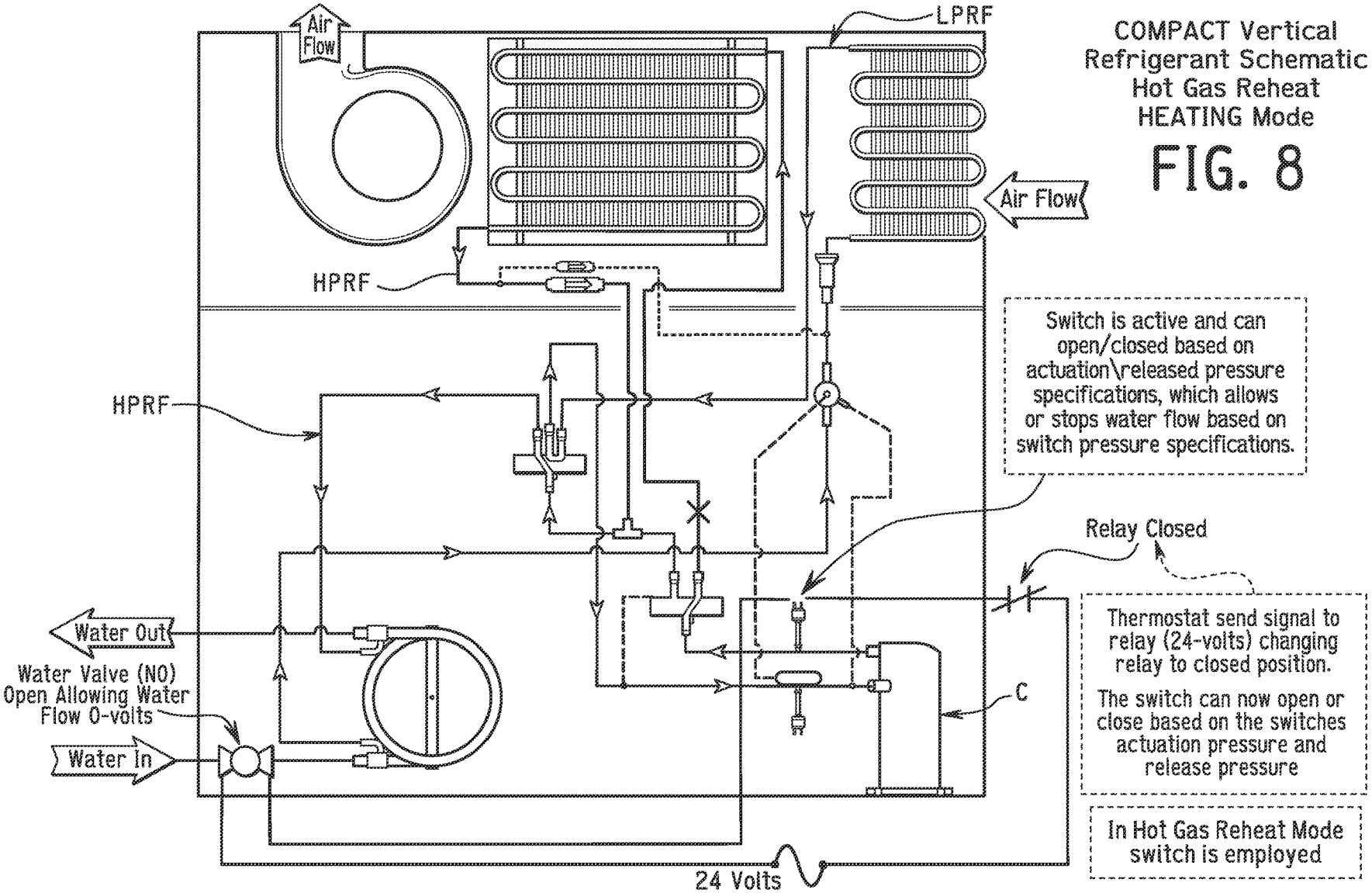
FIG. 8 is a schematic view of the heat pump illustrated in FIGS. 5-7, in the hot gas reheat mode with the switch opened and the relay closed so that the water valve allows the flow of water but is capable of prohibiting water flow to the water coil.

The water valve (WV) and the head pressure control switch (HPCS) are connected in and form parts of a water valve control circuit, which is shown in FIGS. 6-14. FIGS. 5 and 8 illustrate a hot gas reheat mode of this embodiment. This operation is different than the hot gas reheat mode operation of FIGS. 3-4. On the other hand, FIGS. 6-7 illustrate cooling and heating modes of this embodiment, respectively. Despite the additional parts, i.e., the water valve (WV), the head pressure control switch (HPCS) and the other parts of the water valve control circuit, in the cooling and heating modes of FIGS. 6-7, the heat pump (1') of this embodiment operates the same as cooling and heating modes of FIGS. 1-2, respectively (note the "x" on the flow path at several locations). In FIGS. 6-8, the High Pressure Switch is removed, i.e., only the head pressure control switch (HPCS) is shown for the sake of illustration.

In this case, the water valve (WV) is a "normally open" valve, and thus, unless the relay and the head pressure control switch (HPCS) are both closed, the water valve (WV) will remain open so that water flows to the water coil (16). However, it will be apparent to those skilled in the art from this disclosure that the water valve can be a "normally closed" valve. In such a situation, the switch and the relay operations as well as the control signals could be reversed without departing from the scope of the present invention. In any case, the water valve (WV) is preferably controlled to be open/closed as explained below.

Referring to FIG. 5, an operation in the hot gas reheat mode is illustrated in which the heat pump of this embodiment operates the same as the heat pump of FIGS. 3-4 in the hot gas reheat mode. However, in FIG. 8 an operation in the hot gas reheat mode is illustrated in which the heat pump of this embodiment operates differently than the heat pump of FIGS. 3-4 in the hot gas reheat mode. Specifically, in FIG. 8, the water valve can be closed so no water flows to the water coil (16). This occurs when the thermostat closes the relay as shown (because the heat pump is in the hot gas reheat mode—not in the cooling or heating mode), and the head pressure control switch (HPCS) is closed due to the pressure at the head pressure control switch (HPCS) being below an actuation pressure. See FIGS. 8 and 12. In other words, in FIG. 8 the head pressure control switch (HPCS) can control whether the water valve (WV) is open or closed based on the logic shown in FIGS. 9-13.

Referring to FIG. 9-13, the water valve control circuit will now be explained in more detail.

Figure 9:
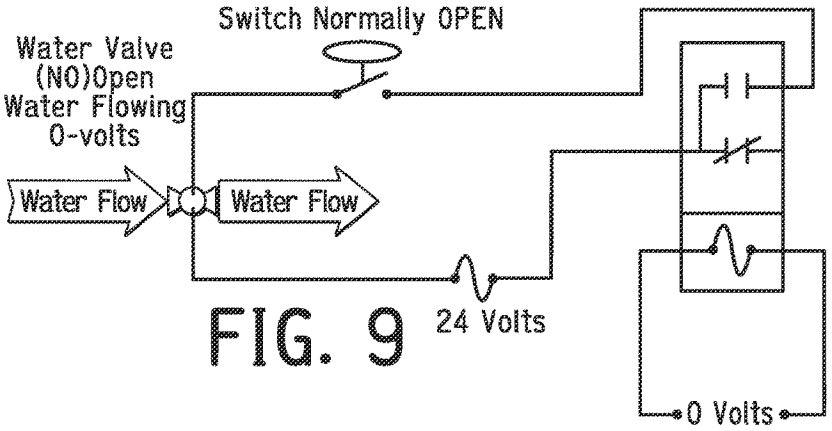
FIG. 9 is a schematic view of a water valve control circuit in a heating or cooling mode with the switch open, and so the thermostat keeps the relay open so that the water valve is open.

In FIG. 9 the heat pump is in a heating or cooling mode with the switch open. The thermostat is keeping the relay open so that the water valve is open so that regardless of the position of the switch, the control circuit is not closed and the water valve (WV) remains open, i.e., the water valve is a normally open valve in this embodiment. Regardless of the pressure, if the relay is open, such as in the heating or cooling mode, the water valve (WV) will remain open allowing the water to flow.

Figure 10:
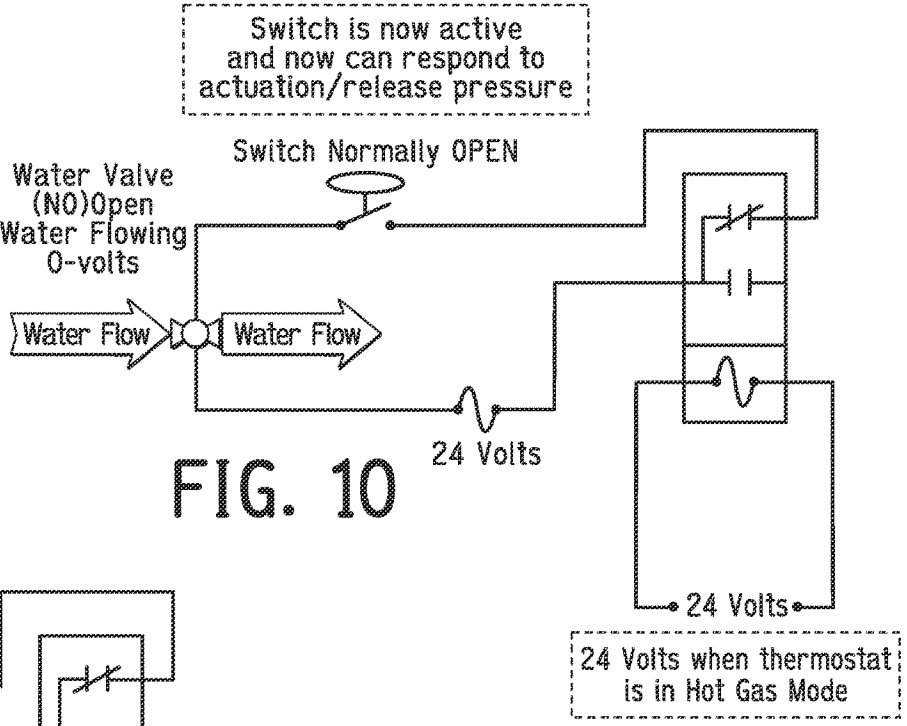
FIG. 10 is a schematic view of the water valve control circuit of FIG. 9, but in the hot gas reheat mode with the relay closed so that the water valve being open or closed is determined by the switch, which is shown open in this Figure so that the water valve is open.

In FIG. 10, the relay is closed because the heat pump is in the hot gas reheat mode. Thus, the switch is now active to determine if the control circuit is closed. In FIG. 10, the switch is in the normally open position and the water valve (WV) remains open, i.e., the water valve is a normally open valve in this embodiment.

Figure 11:
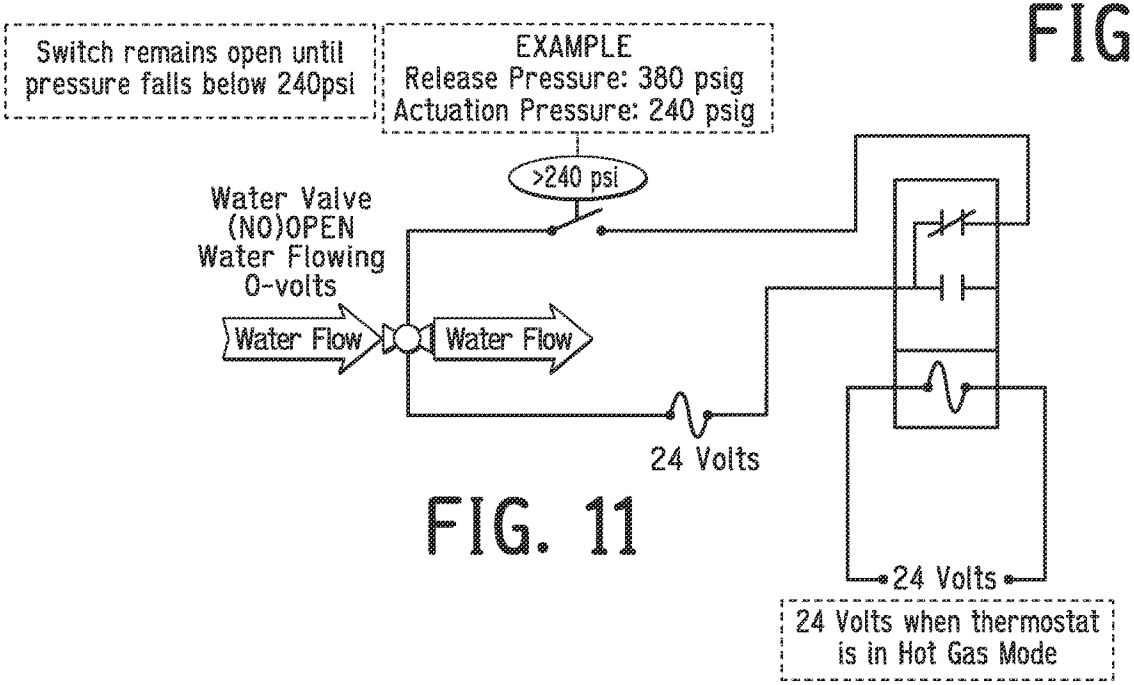
FIG. 11 is a schematic view of water valve control circuit of FIG. 10 in the hot gas reheat mode with the relay closed so that the water valve being open or closed is determined by the switch, with the switch open in response to the pressure at the switch being above an actuation pressure (e.g., 240 psi) so that the water valve is open.

In FIG. 11, an arrangement similar to FIG. 10 is shown. In FIG. 11, the pressure has been determined, and the pressure is above a release pressure (e.g., 240 psi). Therefore, the switch will remain open so that water continues to flow to the water coil (16). The control circuit will remain in this mode of operation unless the pressure drops below the actuation pressure.

Figure 12:
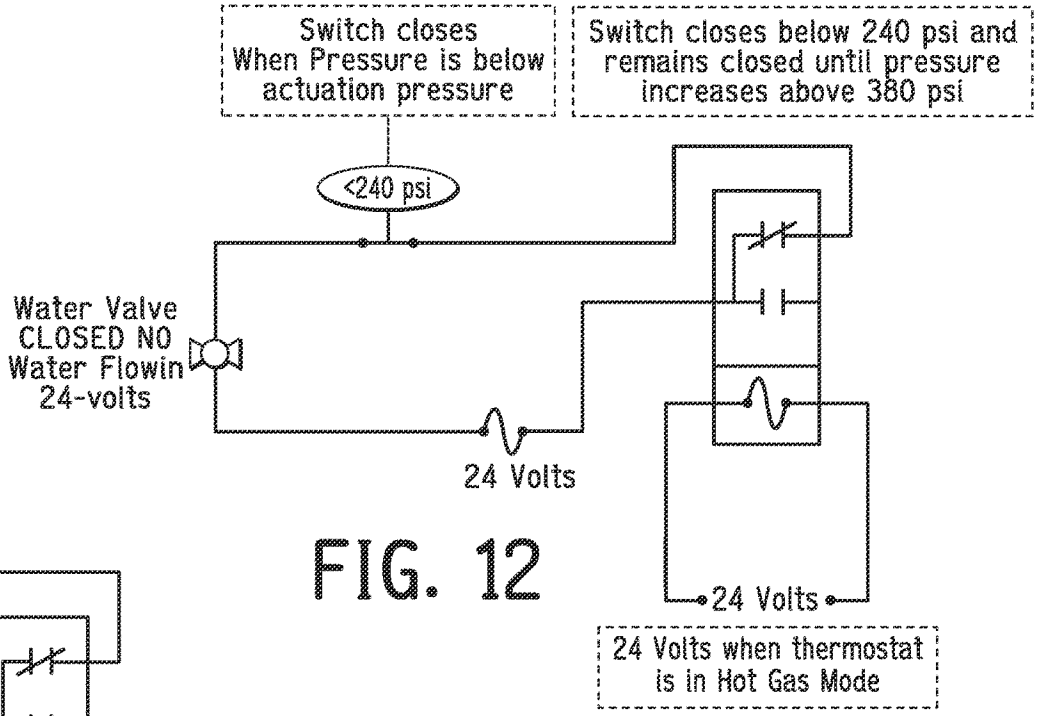
FIG. 12 is a schematic view of water valve control circuit of FIG. 10 in the hot gas reheat mode with the relay closed so that the water valve being open or closed is determined by the switch, with the switch closed in response to the pressure at the switch being below the actuation pressure (e.g., 240 psi) so that the water valve is closed (this can occur in the state shown in FIG. 8)

In FIG. 12, an arrangement like FIG. 11 is illustrated, but after the pressure has dropped below the actuation pressure (e.g., 240 psi). Once the pressure falls below the actuation pressure in the hot gas reheat mode, the switch will close. Note the relay is already closed because the system is in the hot gas reheat mode. Therefore, once the switch is closed, the control circuit is closed and water flow to the water coil (16) is stopped by the water valve (WV). The system will then remain in this configuration until the pressure rises above a release pressure (e.g., 380 psi) that is higher than the actuation pressure. In other words, once the pressure has fallen below the actuation pressure, the switch will remain closed even if the pressure rises about the actuation pressure.

Figure 13:
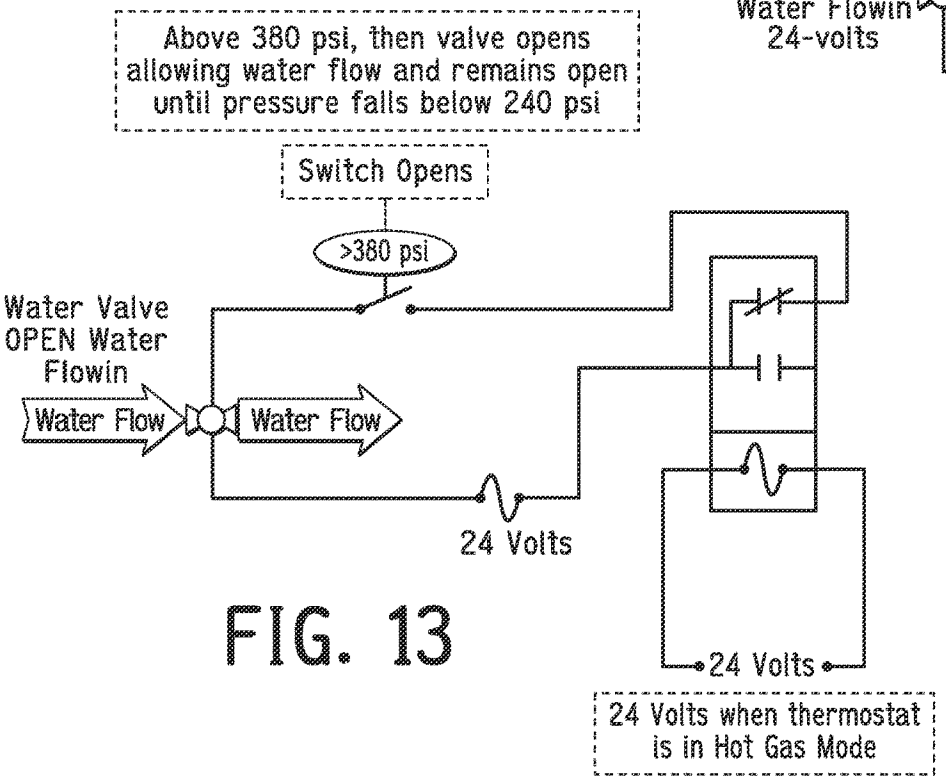
FIG. 13 is a schematic view of water valve control circuit of FIGS. 10-12 in the hot gas reheat mode with the relay closed so that the water valve being open or closed is determined by the switch, with the switch being opened in response to the pressure at the switch rising above a release pressure (e.g., 380 psi) that is above the actuation pressure so that the water valve is closed.

In FIG. 13, an arrangement like FIG. 12 is illustrated but illustrating a situation where the pressure has risen above the release pressure to reopen the switch. The relay is still closed due to the system being in the hot gas reheat mode. Therefore, again, the switch will determine if the control circuit is open or closed. The switch will now remain open unless the pressure falls below the actuation pressure, like FIGS. 11-12. As mentioned above, the actuation pressure is below the release pressure. Due to this configuration, it is possible for the switch to be open or closed at a common pressure between the actuation pressure and the release pressure, depending on if the switch is currently open or currently closed in the hot gas reheat mode.

As can be understood from the above the heat pump system in accordance with the present invention includes a compressor (C), a usage side heat exchanger (14), a heat source side heat exchanger (16), an expansion mechanism (TEV), a main refrigerant flow control device (12), a gas reheat heat exchanger (18), a fan (20), and a secondary refrigerant flow control device (10).

The compressor (C) delivers compressed refrigerant to a discharge line (DL) and receives a refrigerant from a suction line (SL). Examples of compressors include scroll, piston/cylinder, screw, and centrifugal compressor. The compressor (C) of the illustrated embodiment is not limited to a particular type. The usage side heat exchanger is an air/refrigerant heat exchanger, which is identified as a Dx coil or Evaporator (14) in the drawings. One example is a fin and tube heat exchanger. However, the usage side heat exchanger of the illustrated embodiment is not limited to a particular type. The heat source side heat exchanger in the illustrated embodiment is a liquid/refrigerant heat exchanger, more specifically a water/refrigerant heat exchanger, even more specifically a coax water coil (16) arranged to exchange heat between a heat transfer medium (water) and refrigerant flowing therethrough. However, the heat source side heat exchanger of the illustrated embodiment is not limited to a particular type. The expansion mechanism in the illustrated embodiment is a TEV. However, other examples of expansion mechanisms include electronic expansion valves (EEV), and orifices. However, the expansion mechanism is not intended to be limited to any particular type. The main refrigerant flow control device switchable between a cooling mode in which refrigerant flows from the discharge line through a refrigerant circuit, to the heat source side heat exchanger, to the expansion mechanism and then to the usage side heat exchanger, and a heating mode in which refrigerant flows from the discharge line through the refrigerant circuit to the usage side heat exchanger, to the expansion device and then to the heat source side heat exchanger. The main refrigerant flow control device of the illustrated embodiment is a 4-way reversing valve (12). Other examples include multiple one, two and/or three way valves. However, the main refrigerant flow control device is not intended to be limited to any particular type. The gas reheat heat exchanger (18) connected in the refrigerant circuit is an air/refrigerant heat exchanger. One example is a fin and tube heat exchanger. However, the gas reheat heat exchanger of the illustrated embodiment is not limited to a particular type. The fan (20), identified in the drawings as "fan system" is disposed to direct an airflow across the usage side heat exchanger and the gas reheat heat exchanger into a target space. Examples of suitable fans include, an axial flow fan, a cross-flow fan and a centrifugal fan. However, the fan (20) of the illustrated embodiment is not limited to a particular type. The secondary refrigerant flow control device (10) is switchable between a first mode in which refrigerant flows from the discharge line to the main refrigerant flow control device in the heating mode and the cooling mode, and a second mode in which refrigerant flows from the discharge line to the gas reheat heat exchanger in a gas reheat mode and then flows to the main refrigerant flow control device. The secondary refrigerant flow control device in the illustrated embodiment is a three-way valve. Another example of a suitable flow control device is two two-way valves. However, the secondary refrigerant flow control device is not intended to be limited to any particular type. With this arrangement, a flow of the heat transfer medium to the heat source side heat exchanger is adjustable.

As mentioned above, in the illustrated embodiment, the heat transfer medium of the heat source side heat exchanger is a liquid, for example water. In addition, as mentioned above, in the illustrated embodiment, the source side heat exchanger is a coaxial heat exchanger. In addition, the heat pump also preferably includes a heat transfer medium flow control device disposed on an inlet side of the heat source side heat exchanger to adjust flow of the heat transfer medium into the heat source side heat exchanger. In the illustrated embodiment, the heat transfer medium flow control device is a liquid valve, for example a water valve that is open or closed. However, the heat transfer medium flow control device is not intended to be limited to any particular type. Therefore, the heat transfer medium flow control device includes a flow control valve.

The heat transfer medium flow control device in accordance with the embodiment permits flow of the heat transfer medium to flow to the heat source side heat exchanger when secondary refrigerant flow control device is in the first mode in the heating mode and the cooling mode, and the heat transfer medium flow control device is configured to adjust flow of the heat transfer medium to the heat source side heat exchanger when secondary refrigerant flow control device is in the second mode in the gas reheat mode.

In addition, the heat pump also preferably includes a control element disposed between a discharge port of the compressor (C) and an inlet of the gas reheat heat exchanger, the control element being configured to control the heat transfer medium flow control device. In the illustrated embodiment, an example of the control element is the head pressure control switch (HPCS). However, the control element is not intended to be limited to any particular type. Therefore, the control element includes a switch. The switch is connected in a control circuit to the heat transfer medium flow control device. In addition, the control circuit includes a relay that receives a wired or wireless signal from a thermostat to open or close the relay. Moreover, the switch includes a pressure control switch that is normally open unless a pressure of refrigerant at the control element falls below an actuation pressure.

As explained above, once the pressure at the control element has fallen below the actuation pressure, the switch will be closed until the pressure at the control element rises above a release pressure that is higher than the actuation pressure. If the pressure control switch is in a normally open position, the pressure control switch will remain in the open position even when the pressure at the control element falls below the release pressure.

As mentioned above, in the illustrated embodiment the secondary refrigerant flow control device (10) is a three-way valve that selectively communicates refrigerant from the refrigerant circuit to said reheat coil and the main refrigerant flow control device is a reversible four-way valve. In the illustrated embodiment, the gas reheat heat exchanger is positioned upstream of the usage side heat exchanger in the gas reheat mode along the refrigerant circuit, and the gas reheat heat exchanger is positioned upstream of the main refrigerant flow control device in the gas reheat mode along the refrigerant circuit.

Figure 14:
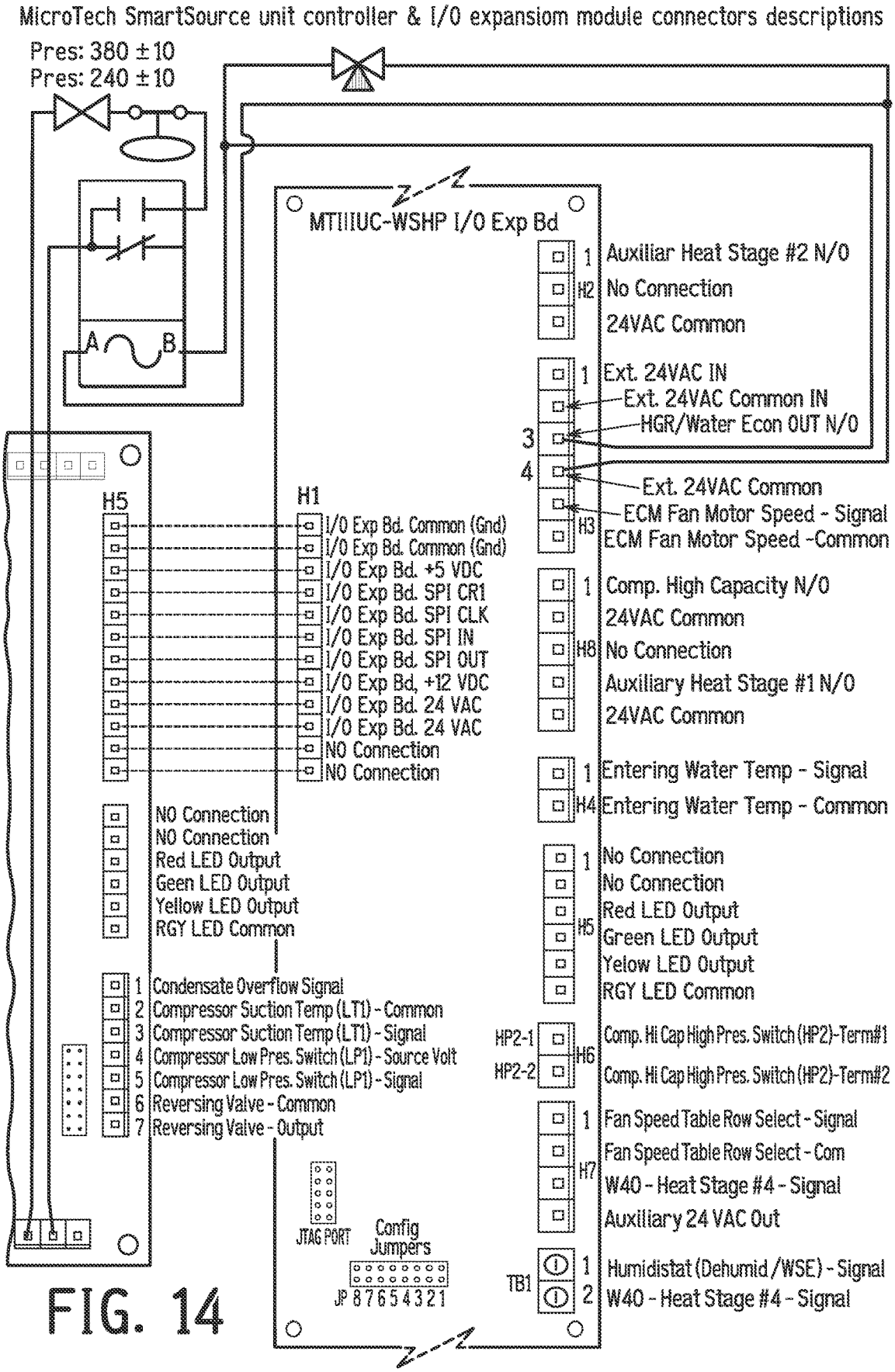
FIG. 14 is a schematic view of a MicroTech SmartSource unit controller and I/O expansion module connected to the water valve control circuit of FIGS. 9-13 and illustrating one suitable thermostat.

FIG. 14 illustrates a schematic view of a MicroTech SmartSource unit controller and I/O expansion module connected to the water valve control circuit of FIGS. 9-13 and illustrates one suitable thermostat. As seen in FIG. 14, an example of a suitable actuation pressure is 380 plus or minus 10 psi, and an example of a suitable release pressure is 240 plus or minus 10 psi. However, as shown in FIG. 11, the switch actuation pressure and release pressure are specified based on the application, and thus, can be different than shown in FIG. 14 depending on the application. It will be apparent to those skilled in the art from this disclosure that an electronic controller can be used to control the water valve control circuit, or it can be controlled using other conventional techniques. If an electronic controller is used the electronic controller is conventional, and thus, includes at least one microprocessor or CPU, an Input/output (I/O) interface, Random Access Memory (RAM), Read Only Memory (ROM), a storage device (either temporary or permanent) forming a computer readable medium programmed to execute one or more control programs to control the heat pump. The electronic controller may optionally include an input interface such as a keypad to receive inputs from a user and a display device used to display various parameters to a user. The parts and programming are conventional, except as related to controlling surge, and thus, will not be discussed in detail herein, except as needed to understand the embodiment(s).

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A method of conditioning air comprising:

operating a heat pump comprising, a compressor, the compressor configured to deliver compressed refrigerant to a discharge line connected to a refrigerant circuit and receive a refrigerant from a suction line;

a usage side heat exchanger;

a heat source side heat exchanger arranged to exchange heat between a heat transfer medium and the refrigerant flowing therethrough;

an expansion valve;

a main refrigerant flow control valve;

a gas reheat heat exchanger connected in the refrigerant circuit;

a fan disposed to direct an airflow across the usage side heat exchanger and the gas reheat heat exchanger into a target space;

a secondary refrigerant flow control valve; and a heat transfer medium flow control valve;

controlling the secondary refrigerant flow control valve to select between a first mode in which refrigerant flows from the discharge line to the main refrigerant flow control valve, and a second mode in which refrigerant flows from the discharge line to the gas reheat heat exchanger and then flows to the main refrigerant flow control valve; and controlling the heat transfer medium flow control valve to adjust the flow of the heat transfer medium into the heat source side heat exchanger, the heat transfer medium flow control valve allowing the heat transfer medium to flow to the heat source side heat exchanger when the secondary refrigerant flow control valve is in the first mode, and the heat transfer medium flow control valve being configured to adjust the flow of the heat transfer medium to the heat source side heat exchanger when the secondary refrigerant flow control valve is in the second mode.

2. The method of claim 1, wherein the main refrigerant control valve is switchable between a cooling mode in which refrigerant flows from the discharge line through a refrigerant circuit, to the heat source side heat exchanger, to the expansion valve and then to the usage side heat exchanger, and a heating mode in which refrigerant flows from the discharge line through the refrigerant circuit to the usage side heat exchanger, to the expansion valve and then to the heat source side heat exchanger.

3. The method of claim 1, wherein the heat transfer medium flow control valve is disposed on an inlet side of the heat source side heat exchanger.

4. The method of claim 1, wherein the heat transfer medium of the heat source side heat exchanger is water.

5. The method of claim 1, wherein the source side heat exchanger is a coaxial heat exchanger.

6. The method of claim 1, wherein the step of controlling heat transfer medium flow control valve is performed using a control switch and wherein the heat transfer medium flow control valve is disposed between a discharge port of the compressor and an inlet of the gas reheat heat exchanger.

7. The method of claim 6, wherein the control switch is connected in a control circuit to the heat transfer medium flow control valve.

8. The method of claim 7, wherein the control circuit includes a relay that receives a wired or wireless signal from a thermostat to open or close the relay.

9. The method of claim 7, wherein the control switch includes a pressure control switch that is normally open unless a pressure of refrigerant at the control switch falls below an actuation pressure.

10. The method of claim 9, further comprising closing the control switch once the pressure at the control switch has fallen below the actuation pressure, and opening the control switch when the pressure at the control switch rises above a release pressure that is higher than the actuation pressure.

11. The method of claim 10, wherein when the pressure control switch is in a normally open position, the pressure control switch remains in the open position even when the pressure at the control switch falls below the release pressure.

12. The method of claim 1, wherein the secondary refrigerant flow control valve is a three-way valve that selectively communicates refrigerant from the refrigerant circuit to the gas reheat heat exchanger.

13. The method of claim 1, wherein the main refrigerant flow control valve is a four-way valve.

14. The method of claim 1, wherein the gas reheat heat exchanger is positioned upstream of the usage side heat exchanger in the gas reheat mode along the refrigerant circuit.

15. The method of claim 1, wherein the gas reheat heat exchanger is positioned upstream of the main refrigerant flow control valve in the gas reheat mode along the refrigerant circuit.

16. A method of controlling the temperature and humidity of air using a heat pump, the method comprising:

compressing a refrigerant using a compressor, the compressor configured to direct the compressed refrigerant to a discharge line connected to a refrigeration circuit;

selecting between a first mode in which refrigerant flows from the discharge line to a main refrigerant flow control valve, and a second mode in which refrigerant flows from the discharge line to a gas reheat heat exchanger and then flows to the main refrigerant flow control valve; and adjusting the flow of a heat transfer medium to a heat source side heat exchanger when the second mode is selected.

17. The method of claim 16, wherein the step of selecting between a first mode and a second mode is performed using a secondary refrigerant flow control valve that is in communication, directly or indirectly, with a thermostat.

18. The method of claim 16, wherein the step of adjusting the flow of the heat transfer medium is performed using a heat transfer medium flow control valve that is in communication, directly or indirectly, with a thermostat.

19. The method of claim 17, further comprising selecting between a cooling mode in which refrigerant flows from the discharge line through the refrigeration circuit, to the heat source side heat exchanger, to an expansion valve and then to a usage side heat exchanger, and a heating mode in which refrigerant flows from the discharge line through the refrigeration circuit to the usage side heat exchanger, to the expansion valve and then to the heat source side heat exchanger.

20. The method of claim 19, wherein the step of selecting between a cooling mode and a heating mode is performed using a main refrigerant control valve that is in communication, directly or indirectly, with a thermostat.

* * * * *